US009879337B2

(12) United States Patent
Verrier

(10) Patent No.: US 9,879,337 B2
(45) Date of Patent: Jan. 30, 2018

(54) METHOD OF SPRAY COATING A SURFACE HAVING A MAGNESIUM BASE

(71) Applicant: Pratt & Whitney Canada Corp., Longueuil (CA)

(72) Inventor: Pierre Verrier, Ste-Julie (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 223 days.

(21) Appl. No.: 14/136,237

(22) Filed: Dec. 20, 2013

(65) Prior Publication Data

US 2015/0174610 A1 Jun. 25, 2015

(51) Int. Cl.

| | |
|---|---|
| ***C23C 24/00*** | (2006.01) |
| ***C23C 4/02*** | (2006.01) |
| ***C23C 24/04*** | (2006.01) |
| ***C23C 22/24*** | (2006.01) |

(52) U.S. Cl.
CPC ..... *C23C 4/02* (2013.01); *C23C 22/24* (2013.01); *C23C 24/04* (2013.01)

(58) Field of Classification Search
CPC ..... C23C 22/24
See application file for complete search history.

(56) References Cited

U.S. PATENT DOCUMENTS

| | | | | |
|---|---|---|---|---|
| 2,902,348 A | 9/1959 | Ostrander | | |
| 4,546,087 A | 10/1985 | Wilson | | |
| 4,614,607 A * | 9/1986 | Loch | C23G 1/125 | 216/101 |
| 2003/0174915 A1* | 9/2003 | Parsoneault | F16C 17/026 | 384/110 |
| 2007/0264511 A1* | 11/2007 | Ponzellini | C23C 22/34 | 428/457 |
| 2009/0011123 A1* | 1/2009 | Bunting | B23P 6/007 | 427/142 |

FOREIGN PATENT DOCUMENTS

| | | | |
|---|---|---|---|
| EP | 0713957 | 5/1996 | |
| GB | 812665 A * | 4/1959 | C23C 22/24 |

OTHER PUBLICATIONS

Eickner, H. W. Effect of Surface Treatment on the Adhesive Bonding Properties of Magnesium. ANC-23 Panel on Sandwich Construction. United States Department of Agriculture Forest Services. Report No. 1865, Jun. 1958.*

Shashikala et al. Chemical Conversion Coatings on Magnesium Alloys—A Comparative Study. Int. J. Electrochem. Sci., 3 (2008) 993-1004.*

* cited by examiner

*Primary Examiner* — David Turocy
(74) *Attorney, Agent, or Firm* — Norton Rose Fulbright Canada LLP

(57) ABSTRACT

A method of spray coating a surface having a magnesium base is provided. The method includes, in sequence, applying a magnesium oxidizing agent onto the surface; determining whether an entirety of the surface has oxidized as a result of applying the magnesium oxidizing agent onto the surface; and spray coating the surface.

8 Claims, 3 Drawing Sheets

METHOD OF SPRAY COATING A SURFACE HAVING A MAGNESIUM BASE

TECHNICAL FIELD

The application relates generally to spray coatings, and more specifically to detection of a residual coating on a surface.

BACKGROUND OF THE ART

Before spray coating a surface, one has to ensure that the surface is free of dirt or residual coating, as these could impair adhesion of the coating to the substrate. In some cases, it is difficult to visually detect the presence of a residual coating. The residual coating may have the same appearance that the surface it is partially covering. In such cases, one would unknown to him/her spray coat a surface that is covered with residual coating and therefore obtain a coating of lesser quality.

SUMMARY

In one aspect is provided a method of spray coating a surface having a magnesium base, the method comprising, in sequence: applying a magnesium oxidizing agent onto the surface; determining whether an entirety of the surface has oxidized as a result of applying the magnesium oxidizing agent onto the surface; and spray coating the surface.

DESCRIPTION OF THE DRAWINGS

Reference is now made to the accompanying figures in which.

DETAILED DESCRIPTION

Figure 1:
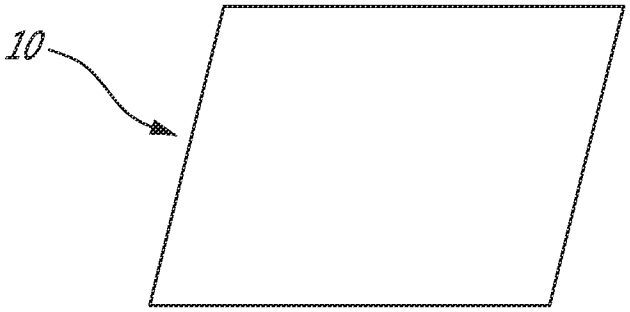
FIG. 1 is a schematic view of a surface having a magnesium base.

Referring to FIG. 1, a surface 10 (or substrate) is a magnesium alloy. In one example, the surface 10 is made of AMS 4439. The surface 10 has a generally silver color appearance and is homogenous in color. It is contemplated that the surface may not be homogeneous in color, but still have a silver appearance. Although the surface 10 is shown schematically in FIG. 1 to be flat, it is contemplated that the surface 10 could be curved, annular or have sharp edges, and could have any shape. The surface 10 can be used in cold sections of an engine case. For example, the surface 10 could be used in a rear or front inlet case, a gearbox or a front housing, to name a few. The surface 10 may be a surface that may have previously undergone treatments such as previous coatings. In the present case, the surface 10 may have a residual of aluminum-silicon. The aluminum-silicon may not be distinguishable visually from the magnesium base of the surface 10, as both may appear silver to the user. The surface 10 has been pre-machined in view of a spray coating operation, yet may still have aluminum-silicon residual. It is contemplated, however, that the surface 10 could not be pre-machined.

Figure 2:
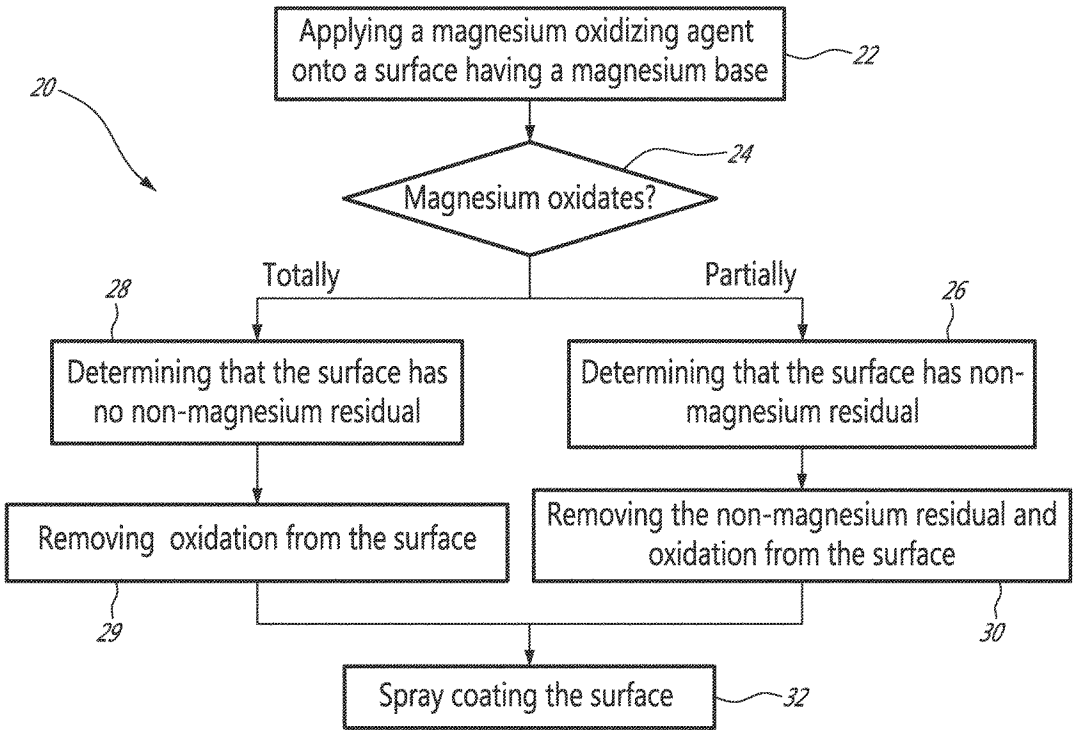
FIG. 2 is a flow chart of a method of spray coating a surface such as the surface of FIG. 1.
Figure 3:
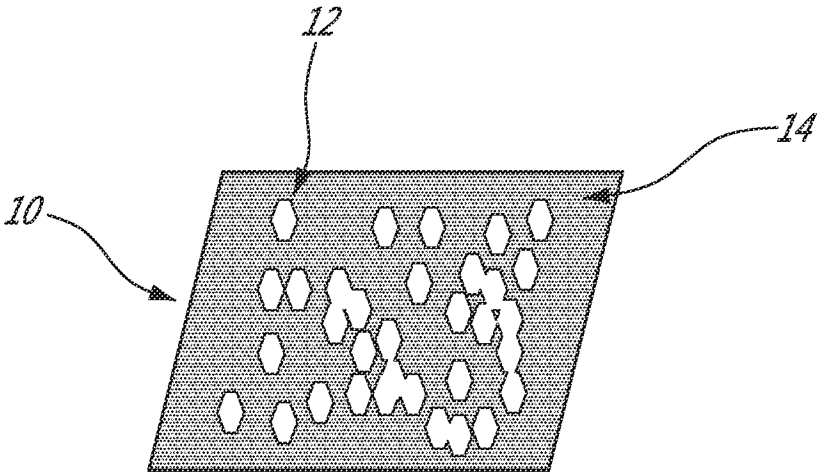
FIG. 3 is a schematic view of the surface of FIG. 1 after a step of the method of FIG. 2 revealed residual coating.

Turning to FIG. 2, a method 20 of spray coating the surface 10 will now be described. The method 20 starts at step 22 with applying a magnesium oxidizing agent onto the surface 10. The oxidation agent is a chemical chromate converter which reacts with, i.e. oxides, the magnesium contained in the surface 10. The oxidation agent, however, does not react with the aluminum-silicon residual on the surface 10, as it is a non-magnesium residual. The reaction between the oxidation agent and the magnesium is an oxidation which creates an oxidation layer of generally brown color. The change of color of the surface 10 at those areas of the surface 10 not covered by non-magnesium residuals, such as the aluminum-silicon residual, will allow their visual distinction. A schematic of the surface 10 after application of the oxidation agent and that has partially oxidized is shown in FIG. 3. In that schematic, areas of the surface 10 that have remained silver are illustrated by reference numeral 12 and correspond to non-magnesium residuals (in the example described herein: aluminum-silicon residual), while the rest of the surface 10 is shown in a darker color to illustrate brown color of the oxidation layer 14 coming from the reaction of the magnesium with the oxidation agent.

The chromate converter used herein is IRIDITE 15. It is contemplated that any oxidation agent which would react with magnesium and wouldn't react with aluminum-silicon could be used on the surface 10 and an oxidation agent. The solution of chromate converter is applied onto the surface 10 using a brush. It is contemplated that the chromate converter could be sprayed onto the surface 10.

From step 22, the method 20 goes to step 24 where it is determined, after applying the magnesium oxidizing agent onto the surface 10, whether an entirety of the surface 10 has oxidized as a result of it. The determination is done visually by inspecting the surface 10 for a change of color. If the surface 10 oxidises partially, i.e. if only a portion of the surface 10 has changed color from silver to brown, then the method goes to step 26 where it is determined that the surface 10 has non-magnesium residual.

From step 26, the method goes to step 30 where the residual 12 and the oxidation 14 is removed from the surface 10. One way to remove the residual coating of aluminum-silicon 12 and the oxidation 14 is to machine the surface 10. The surface 10 is machined slightly using a technique called kiss machining. It is contemplated that the surface 10 could be grit blast. It is also contemplated that the residual coating could be removed by other mechanical processes, or that the step of removing the residual coating 12 and oxidation 14 could be omitted. Once the non-magnesium residual 12 is removed, the method goes to step 32, where the surface 10 is spray coated. The surface 10 is coated using cold spray. In cold spraying, a gas is pressurized and consequently expanded with particles of aluminum-silicon so as to impart a sonic velocity to the particles to effectively coat the surface 10. It is contemplated that techniques other than spray coating could be used to coat the surface 10. For example, plasma spraying could be used. The surface 10 may be coated with yet another layer of aluminum-silicon.

If, however, at step 24 the surface 10 oxides totally, i.e. if it is observed that the entirety of the surface 10 has changed color from silver to brown with no remaining areas of silver, then the method goes to step 28 where it is determined that the surface 10 has no non-magnesium residual 12 (i.e. no residual of aluminum-silicon in the present example). In that case, the entire surface 10 is covered by the oxidation layer 14.

From step 28, the method goes to step 29, where the surface 10 is machined in a manner similar as described above to remove the oxidation layer 14 form the surface 10.

From step 29, the method goes to step 30, where the surface 10 is spray coated.

The above description is meant to be exemplary only, and one skilled in the art will recognize that changes may be made to the embodiments described without departing from the scope of the invention disclosed. The method has been described for detecting residual of aluminum silicon, but it is contemplated that the method could be applied for detecting any non-magnesium residual. It is also contemplated that the steps of applying the oxidation agent, determining that the surface has non-magnesium residual, and removing the non-magnesium residual may be carried multiple times to ensure that the non-magnesium residual is properly removed before spray-coating the surface. Still other modifications which fall within the scope of the present invention will be apparent to those skilled in the art, in light of a review of this disclosure, and such modifications are intended to fall within the appended claims.

The invention claimed is:

1. A method of spray coating a surface having a magnesium base, the method comprising, in sequence:

voluntarily causing oxidation of the surface used by applying a magnesium oxidizing agent onto the surface, the oxidation being a visual distinction relative to the surface;

observing whether an entirety of the surface has oxidized as a result of applying the magnesium oxidizing agent onto the surface to create the visual distinction;

observing oxidation of only a portion of the surface;

determining that the surface has non-magnesium residual as a result of observing only partial oxidation of the surface;

removing the non-magnesium residual and oxidation from the surface; and spray coating the surface free of oxidation with aluminum-silicon after removing the non-magnesium residual and oxidation.

2. The method as defined in claim 1, wherein applying the magnesium oxidizing agent onto the surface comprises applying a solution of chromate converter onto the surface.

3. The method as defined in claim 2, wherein applying the solution of chromate converter onto the surface comprises applying a solution of IRIDITE 15 onto the surface.

4. The method as defined in claim 1, wherein spray coating the surface comprises one of cold spraying and plasma spraying the surface.

5. The method as defined in claim 1, wherein spray coating the surface comprises cold spraying the surface with aluminum-silicon.

6. The method as defined in claim 1, wherein determining that the surface has non-magnesium residual comprises determining that the surface has aluminum-silicon residual.

7. The method as defined in claim 1, wherein observing oxidation of only a portion of the surface comprises observing the portion of the surface changing color.

8. The method as defined in claim 1, wherein removing the non-magnesium residual and oxidation comprises machining the surface.

* * * * *